United States Patent [19]

Zambolin et al.

[11] 3,991,875

[45] Nov. 16, 1976

[54] DEVICE FOR MOVING CARDS OR SEPARATE FORMS IN AN ACCOUNTING MACHINE

[75] Inventors: Adriano Zambolin, Ivrea (Turin); Dario Bisone, Montalto Dora (Turin), both of Italy

[73] Assignee: Ing. C. Olivetti & C. S.p.A., Ivrea (Turin), Italy

[22] Filed: Nov. 20, 1974

[21] Appl. No.: 525,735

[30] Foreign Application Priority Data

Dec. 27, 1973 Italy ..... 70859/73

[52] U.S. Cl. ..... 197/127 R; 271/258

[51] Int. Cl.² ..... B41J 13/03

[58] Field of Search ..... 197/127; 271/258, 259

[56] References Cited

UNITED STATES PATENTS

| | | | |
|---|---|---|---|
| 2,424,073 | 7/1947 | Ayres | 197/127 R |
| 3,266,612 | 8/1966 | Kittel et al. | 197/127 R |
| 3,456,772 | 7/1969 | Templeton | 197/127 R |
| 3,495,904 | 2/1970 | Kelsch et al. | 271/258 X |
| 3,718,244 | 2/1973 | Bukowski et al. | 197/127 R |

*Primary Examiner*—Anton O. Oechsle

[57] ABSTRACT

The present invention relates to a device for driving, stopping and line-spacing cards or separate forms, in an accounting machine. A plurality of rollers, actuated by a motor, moves the cards or the separate forms for a predetermined number of printing lines. A control unit selectively activates a coupling device for connecting the motor to the rollers. A counting device is connected to the rollers by a coupling commanded by the control unit.

2 Claims, 2 Drawing Figures

DEVICE FOR MOVING CARDS OR SEPARATE FORMS IN AN ACCOUNTING MACHINE

BACKGROUND OF THE INVENTION

The present invention relates to a device for driving, stopping and line-spacing cards or separate forms in an accounting machine, comprising a control unit, a motor controlled by the control unit, a plurality of rollers actuated by the motor for moving the cards or the separate forms for a predetermined number of printing lines, a first coupling device adapted to be activated selectively by the control unit to connect the motor to the rollers, counting means for counting the printing lines, a second coupling device adapted to be activated selectively by the control unit to connect the counting means to the said rollers, and a clutch commanded by the control unit having a driving element connected to the first coupling device and a driven element connected to the counting means. Such an arrangement is hereinafter referred to as an arrangement of the type defined.

Various arrangements for driving cards, or separate forms are known. In these arrangements the positioning of the cards in the printing zone is generally effected manually by raising the paper-gripping rollers by means of a suitable lever and carrying out the alignment of the cards with the printing line by eye, with the aid of a reference index fixed to the machine. In such arrangements the line-spacing is effected automatically by the machine by rotating the platen by one line-spacing step. The positioning of the cards is therefore very slow with respect to the machine cycle times and the line-spacing cannot be carried out on the card independently of other documents passed around the platen.

In other arrangements the drive of the card is effected by means of independently motor-driven rollers employing mechanical clutches controlled by electromagnets for effecting the line-spacing and stopping of the cards. These arrangements are bulky and of considerable structural complexity and have very high actuation times because of the unavoidable delays and inertias of the various moving mechanical parts, these times being no longer compatible with the high working speeds of modern office machines.

SUMMARY OF THE INVENTION

These disadvantages are overcome by the driving device according to the present invention. Accordingly a general object of the present invention is to provide a device for automatically driving, stopping and line-spacing cards or separate forms, wherein a first device and a second device comprise an electromagnetic coupling adapted to be actuated selectively by the control unit to connect the counting means between the motor and the rollers.

The invention will be described in more detail, by way of example, with reference to the accompanying drawings.

DESCRIPTION OF THE PREFERRED EMBODIMENT

Figure 1:
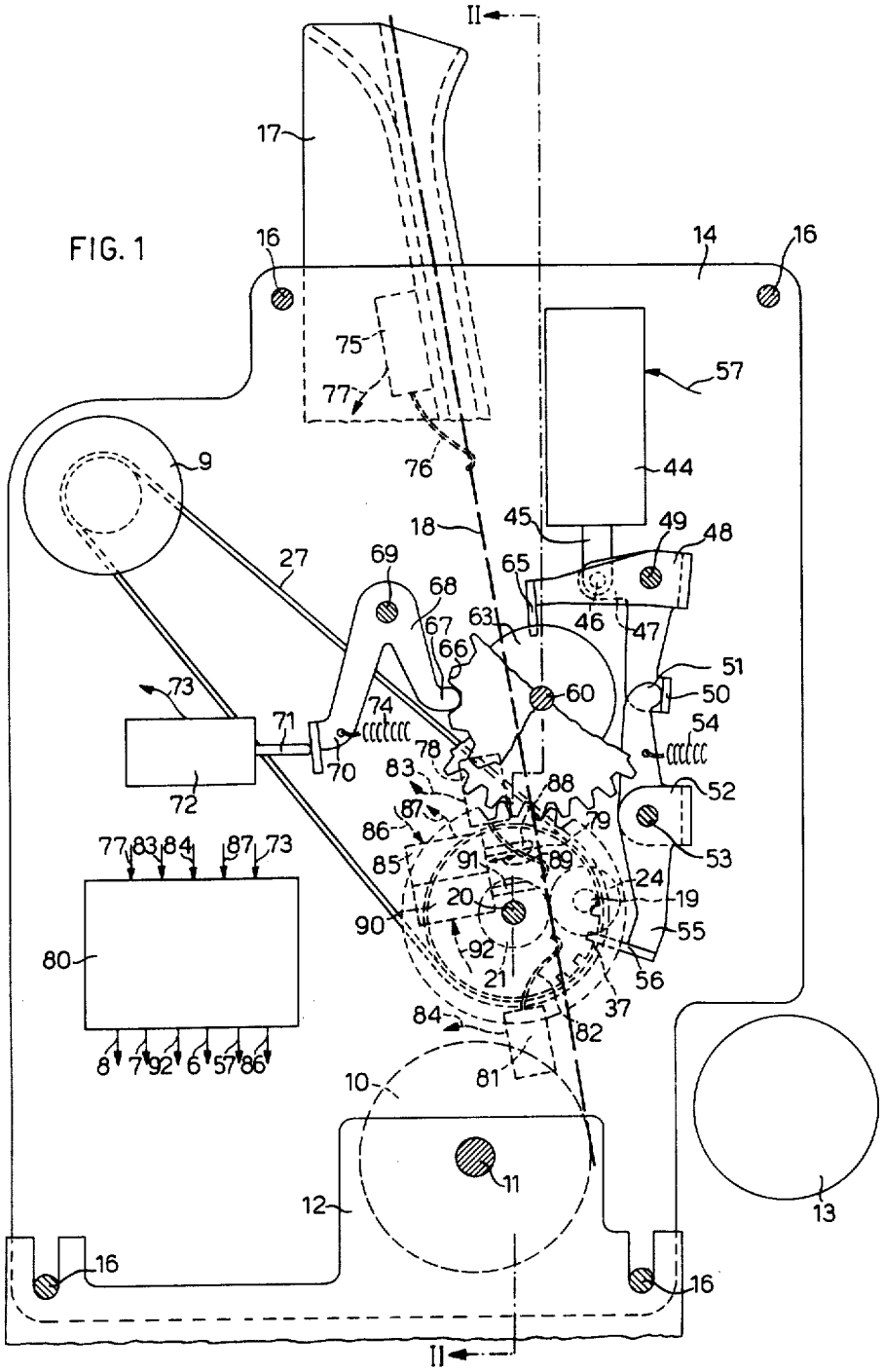
FIG. 1 is a vertical section of an arrangement embodying the present invention on the line I—I of FIG. 2.

The device for controlling the movement of cards or separate forms is mounted on an accounting machine comprising a platen 10 (FIG. 1) supported by a spindle 11 which is rotatable in the frame 12 of the machine, and a printing head 13 movable along the platen 10. The arrangement for controlling the movement of cards is enclosed between two side panels 14 and 15 (FIGS. 1 and 2) rigidly interconnected by rods 16.

On the outside of the side panel 14 there is rigidly fixed a hopper 17 of known type and not described in detail for guiding a card or a separate form 18. A shaft 20 rotatable in the side panels 14 and 15 extends across the entire width of the hopper 17. Rigidly fixed on the shaft 20 at regular intervals are rollers 21 for driving the cards 18. A shaft 19 (FIG. 1) on which counter-rollers 24 can rotate is also fixed to the hopper 17 by means of resilient supports of known type and not shown in the drawings. An assembly formed by an electromagnetic clutch 22 and an electromagnetic brake 23 (FIG. 2) is arranged on the shaft 20. A pulley 25, which can rotate idly on the shaft 20, comprises a cylindrical portion 26, around which is passed a belt 27 driven by a motor 9, and a toothed portion 28. A first disc 29 of magnetic material is keyed on an end 30 of prismatic section of the pulley 25 and can slide axially, but not rotate, on the end 30. A first element 31 of substantially cylindrical form is keyed rigidly on the shaft 20 and has an extension 32 facing the disc 29. The element 31 is formed of ferromagnetic material. A support 33 fixed to the side panel 14 contains a coil 34 of toroidal form. The parts 25, 29, 31 and 34 constitute the clutch 22.

A gear 35 rotatable on the shaft 20 is provided with a first toothed 36 and a second toothed profile 37 having square teeth. The gear 35 is moreover provided with a hub 38 of prismatic section on which a disc 39 of ferromagnetic material can slide axially, but cannot rotate. An element 40 of substantially cylindrical form and of ferromagnetic material is fast with the shaft 20 and has an extension 41 facing the disc 39. A support 42 fixed to the side panel 15 contains a coil 43 of toroidal form. The parts 35, 39, 41 and 43 constitute the electromagnetic brake 23.

A solenoid 44 (FIG. 1) fixed to the side panel 14 is provided with a plunger 45. The plunger 45 is connected by means of a pin 46 to a first lug 47 of a bail 48 which can turn on a shaft 49. A second lug 50 of the bail 48 co-operates with one end 51 of a rocking lever 52 which can turn on a shaft 53 and is biased by a spring 54. The other end 55 of the rocking lever 52 bears a detent 56 adapted to co-operate with the second toothed profile 37.

On a shaft 60 fixed to the side panels 14 and 15 there is mounted a claw coupling 61 of known type constituted by a driving gear 62 rotatable on the shaft 60 and meshing with the toothed part 28 of the pulley 25, an intermediate cylindrical element 63 adapted to control the coupling 61, and a driven gear 64 rotatable on the shaft 60 and meshing with a first toothed profile 36 of the gear 35. A third lug 65 integral with the bail 48 co-operates with the element 63 for the purpose of connecting the driving gear 62 angularly to the driven gear 64 of the coupling 61.

A toothing 66 which co-operates with one end 67 of a rocking lever 68 turning on a pin 69 fixed to the side panel 15 is formed integrally with the driven gear 64. The other end 70 of the rocking lever 68 co-operates with a control pin 71 of a microswitch 72 fixed to the side panel 15. The end 67 of the rocking lever 68 is kept in contact with the toothing 66 by the action of a spring 73.

In the upper part of the hopper 17 there is fixed a microswitch 75 actuated by a feeler 76 for sensing the card 18 when it is introduced. The signal generated by the microswitch 75 is sent by means of a lead 77 to a control unit 80, of well known type and not described in detail, which is constituted essentially by a logic network having five inputs and six outputs and capable of associating with each input signal, or with certain combinations of input signals, a particular output signal.

Another microswitch 78 fixed to the hopper 17 a little above the rollers 21 and actuated by a feeler 79 is adapted to sense the lower edge of the card 18 a little ahead of the driving rollers 21 and 24 when the card 18 is introduced into the hopper 17. A microswitch 81 fixed to the hopper 17 and actuated by a feeler 82 is adapted to sense the lower edge of the card during the expulsion stage a short time before the card leaves upwards the driving rollers 21. When the microswitches 78, 81 are actuated by the passage of a card they generate signals which are sent to the control unit 80 through leads 83 and 84.

Figure 2:
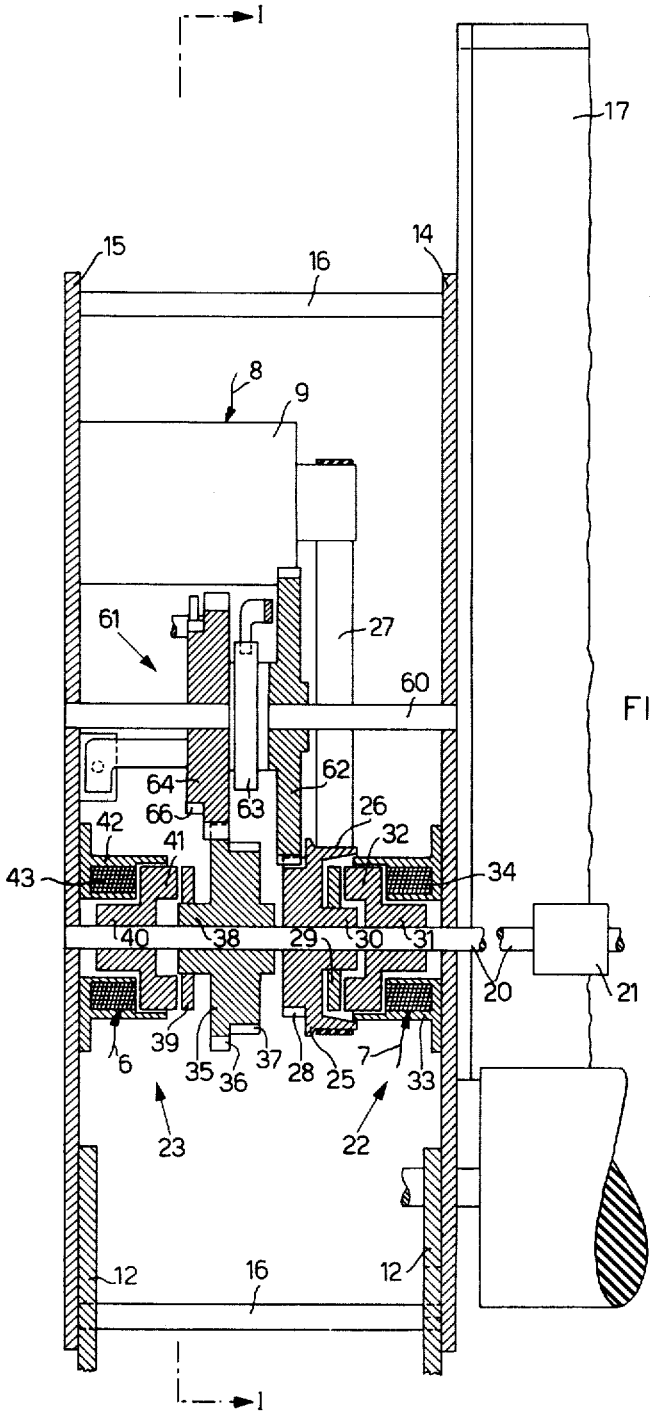
FIG. 2 is a section on the line II—II of FIG. 1.

The arrangement moreover comprises a sensing element of known type and represented for conciseness in FIG. 1 by the block 85, this sensing element essentially comprising an electromagnet which receives command pulses from the control unit 80 through a lead 86 for axially shifting feeler 88 in the two directions indicated by a double arrow 89, and a microswitch which is capable of sending a signal to the control unit 80 through a wire 87 when the card 18 actuates on its passage a feeler 88 connected in known manner to the block 85.

The arrangement is completed by a device 90 adapted to make one or more notches along the lateral edge of the cards to identify the stop positions of the cards in correspondence with the printing lines. The device 90 is of known type and is not described in detail. It is only pointed out that the device 90 comprises a punch 91 which is driven against the card to make a notch at the command of the control unit 80 by means of a signal sent by the unit 80 to the device 90 on a line 92. The punch 91 is moreover arranged lower, and at a distance equal to one line-spacing step, with respect to the feeler 88 of the sensing element 85.

In order to simplify the description of the operation, assume that this is being carried out with a card. The operator inserts the card into the hopper 17 and pushes it downwards. On the passage of the card, the microswitch 75 is actuated by means of the feeler 76, which is in the path of the card.

The microswitch 75 generates a signal which is sent on the line 77 to the control unit 80, which sends current on the line 8 to start the motor 9 in the direction of rotation appropriate for feeding the card between the driving rollers 21 and 24, that is to say clockwise in FIG. 1. Initially, the motor 9 causes the pulley 25 which idles on the shaft 20 to rotate through the medium of the belt 27. When the lower edge of the card actuates the feeler 79 of the microswitch 78, a little ahead of the rollers 21 and 24, the microswitch 78 sends an electric pulse on the line 83 to the unit 80, which sends a signal on the line 86 to the sensing element 85 which causes the feeler 88 to bear against the card, signalling its presence to the unit 80 through a signal sent on the line 87. In this way the unit 80 has received consent to introduce the card into the printing zone. To this purpose, the control unit 80 sends current on the line 7 to energize the coil 34 of the clutch 22. The magnetic flux generated by the coil 34 attracts the ring 29 against the extension 32 of the cylindrical element 31, connecting the pulley 25 in this way to the shaft 20, which is set in clockwise rotation. Two cases now arise:

a. New card

The card is carried along by the rollers 21 and 24 until its upper edge moves beyond the feeler 88. Since the feeler 88 then lacks support, it can move forward, thus generating a stop signal which is sent to the control unit 80 on the line 87. The unit 80 cuts off the current energizing the coil 34 on the line 7, interrupting the connection between the pulley 25 and the shaft 20, and at the same time sends energizing current on the line 6 for the coil 43 of the brake 23. The flux generated by the coil 43 attracts the ring 39 against the extension 41 of the cylindrical element 40 fast with the shaft 20. The ring 39 is prevented from rotating by the prismatic coupling formed on the hub 38 of the pulley 35, which is kept locked in turn by the stop element 56 engaging between the teeth 37 of the pulley 35.

The cylindrical element 40 and the shaft 20 are therefore arrested and the card is disposed fully introduced into the position for printing on the first line. The printing on the first line having been completed, the control unit 80 sends a signal to the device 90 on the line 92 for the making of a notch in correspondence with the second printing line or, in the more general case, in correspondence with whichever is the next printing line.

b. Used card

The card is carried along by the rollers 21 and 24, as described before, until the notch corresponding to the line following the last printed line reaches the feeler 88. A slight movement of the feeler 88 causes the sensing element 85 to send a stop signal on the line 87 to the control unit 80, which sees to the stopping of the card in the manner already described for case (a).

Execution of line-spacing

When it is desired to print on various lines, the arrangement carries out one or more line-spacing operations in the following manner.

After a used card is inserted, when the feeler 88 senses the notch corresponding to the line following the last printed line, i.e., when the feeler 88 senses the notch corresponding to the first line not printed, the sensing element 85 sends to the control unit 80, via line 87, a stop signal for stopping the rotation of the motor. The control unit 80 sends successively on the line 8 a current such as to start the motor 9 in the opposite direction, i.e., in the anti-clockwise direction of rotation. At the same time the control unit 80 sends an energizing current to the solenoid 44 on the line 57.

The plunger 45 moves upwardly and causes the bail 48 to turn clockwise, overcoming the action of the spring 54. The second lug 50 of the bail 48 causes the rocking lever 52 to rotate anticlockwise, so that the stop element 56 is moved away from the teeth 37 of the gear 35. At the same time, the third lug 65 of the bail 48 is raised, actuating the coupling 61 in a well known manner, so that the driving gear 62 is connected mechanically to the driven gear 64, setting the gear 35 in rotation. At the same time, the control unit sends an energizing current to the coil 43 of the brake 23 on the line 6, rendering the gear 35 fast with the cylindrical element 40 fixed on the shaft 20.

The rocking lever 68, the end 67 of which bears against the toothing 66 through the action of the spring 74, actuates the microswitch 72 as many times as there are teeth 66 jumped over by the end 67. The pitch of the toothing 66 corresponds to one line-spacing step on the card 18. The toothing 66, the rocking lever 68 and the microswitch 72 therefore form part of a counting means for counting the line-spacing steps to be executed. The microswitch 72 sends a pulse to the control unit 80 on the line 73 in the manner described for each tooth which passes below the end 67 of the rocking lever 68.

The unit 80 counts the pulses sent by the microswitch 72 and compares them with the programmed pulses. When the number of the pulses counted equals the number of programmed line-spacing steps, the control unit 80 de-energizes the solenoid 44, as a result of which the bail 48 turns anticlockwise, the rocking lever 52 turns clockwise, the third lug 65 opens or disengages the clutch 61, and the stop element 56, interposing itself between the teeth 37 of the gear 35, produces the arrest of the shaft 20 and, consequently, of the card 18.

The printing on the desired line having been carried out, the device 90 makes a notch on the command of the control unit 80 sent on the line 92.

Expulsion of the card

The expulsion of the card takes place after the printing of a line and the respective punching operation, on the command of the control unit 80. The electromagnetic brake 23 therefore always remains energized during the aforesaid operations. The control unit 80 sends to the motor 9 on the line 8 a current such as to set the motor in rotation anticlockwise, interrupts the energizing current of the brake 23 on the line 6, sends an energizing current on the line 7 of the clutch 22 for energizing the coil 34 and, consequently, for connecting the pulley 25 to the shaft 20. The rollers 21 therefore rotate anticlockwise and the card is carried along upwardly. When the lower edge of the card releases the feeler 82 of the microswitch 81, a signal is sent to the control unit 80 on the line 84 for the stopping of the motor 9.

After a certain interval of time equal to the time taken by the lower edge of the card from when it releases the feeler 82 to when it moves beyond the zone of contact with the rollers 21 and 24, the control unit interrupts the supply of current to the motor 9 and to the coil 34 of the clutch 22 and sends an energizing current to the coil 43 of the brake 23 for a very brief time to arrest the rollers immediately.

What we claim is:

1. A driving device for controlling the movement of cards or separate forms with respect to a printing station for accounting machines and the like, comprising:

motor means operable for rotating in a first and in a second direction, indicia stored on said card for determining the position of the next line to be printed on said card, a plurality of rollers actuated by said motor for moving said card along a predetermined number of printing lines in a first or in a second direction according to the direction of said motor means, a first electromagnetic coupling device actuable during said first and second directions of rotation for selectively and directly connecting said motor means to said rollers, means responsive to movement of said card in said first direction for sensing said indicia, means for bypassing said next printing line and positioning a subsequent line of said card adjacent said printing station, said bypassing and positioning means comprising counting means for counting said printing lines, a second electromagnetic coupling device selectively actuatable during said second rotation direction for serially connecting said counting means between said motor means and said rollers, a control unit responsive to said sensing means for reversing the direction of rotation of said motor means and responsive to a predetermined count of said counting means for deactuating said first coupling device and stopping said rollers, whereby said card is stopped, with respect to said printing station, at a subsequent printing line below said next line in accordance with said count of said counting means.

2. A driving device as defined in claim 1, wherein said first device comprises a first and a second member and the second device comprises a third and a fourth member, said first and third members being connected to said rollers, said second and fourth members being connected to said driving element and to said counting means respectively, said first and third members having electric windings energizable by the control unit for coupling said second and fourth members respectively to said first and third members.

* * * * *